US007352142B2

(12) United States Patent
Kim et al.

(10) Patent No.: US 7,352,142 B2
(45) Date of Patent: Apr. 1, 2008

(54) APPARATUS AND METHOD FOR CONTROLLING STROKE OF RECIPROCATING COMPRESSOR

(75) Inventors: Hyung-Joo Kim, Seoul (KR); Kyung Bum Heo, Gyeonggi-Do (KR); Chel-Woong Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 341 days.

(21) Appl. No.: 11/245,109

(22) Filed: Oct. 7, 2005

(65) Prior Publication Data

US 2006/0228226 A1 Oct. 12, 2006

(30) Foreign Application Priority Data

Apr. 6, 2005 (KR) ..... 10-2005-0028670

(51) Int. Cl.
*H02P 1/00* (2006.01)
*H02K 33/16* (2006.01)

(52) U.S. Cl. ..... 318/135; 318/127; 318/632; 417/42.1; 417/417

(58) Field of Classification Search ..... 318/119, 318/126, 127, 128, 132, 135, 632; 417/44.1, 417/45, 53, 417
See application file for complete search history.

(56) References Cited

U.S. PATENT DOCUMENTS 3,916,271 A * 10/1975 Watanabe et al. ..... 318/132
4,027,211 A * 5/1977 Omura et al. ..... 318/127
4,283,920 A * 8/1981 Kainuma et al. ..... 62/126
4,389,849 A * 6/1983 Beggs et al. ..... 62/6
5,032,772 A * 7/1991 Gully et al. ..... 318/135
5,106,267 A * 4/1992 Kawamura et al. ..... 417/45
6,812,597 B2 * 11/2004 McGill et al. ..... 310/12
6,930,462 B2 * 8/2005 Yoo et al. ..... 318/632
6,954,040 B2 * 10/2005 McGill et al. ..... 318/127
7,090,470 B2 * 8/2006 Kim ..... 417/44.11
7,271,563 B2 * 9/2007 Yoo et al. ..... 318/632
7,285,878 B2 * 10/2007 McGill et al. ..... 310/12
2004/0066163 A1 * 4/2004 Yoo et al. ..... 318/632
2004/0239266 A1 * 12/2004 Lee et al. ..... 318/119
2004/0263005 A1 * 12/2004 McGill et al. ..... 310/14
2005/0168179 A1 * 8/2005 McGill et al. ..... 318/119

(Continued)

*Primary Examiner*—Paul Ip
(74) *Attorney, Agent, or Firm*—Birch, Stewart, Kolasch & Birch, LLP

(57) ABSTRACT

An apparatus for controlling an operation of a reciprocating compressor includes a voltage detecting unit for detecting a positive half-wave voltage of an AC voltage applied to a motor of the reciprocating compressor; a current detecting unit for detecting a positive half-wave current of the AC current passing through the motor; a voltage and current estimating unit for estimating a negative half-wave voltage of the AC voltage applied to the motor and a negative half-wave current of the AC current passing through the motor based on the detected positive half-wave voltage and the detected positive half-wave current; a stroke estimating unit for estimating a stroke of the reciprocating compressor based on the detected positive half-wave voltage and the detected positive half-wave current and the negative half-wave voltage and the negative half-wave current which have been estimated by the voltage and the current estimating unit; a stroke controller for outputting a stroke control signal of the reciprocating compressor based on a comparison value between the estimate stroke estimate value and a stroke reference value of the reciprocating compressor; and a power source unit for applying positive DC power to the voltage detecting unit and the current detecting unit.

10 Claims, 4 Drawing Sheets

U.S. PATENT DOCUMENTS

2007/0196214 A1* 8/2007 Bocchiola ..... 417/44.1
2007/0241697 A1* 10/2007 Sung et al. ..... 318/135
2007/0241698 A1* 10/2007 Sung et al. ..... 318/135

* cited by examiner

APPARATUS AND METHOD FOR CONTROLLING STROKE OF RECIPROCATING COMPRESSOR

BACKGROUND OF THE INVENTION

1. Field of the Invention

The present invention relates to a reciprocating compressor and, more particularly, to an apparatus and method for controlling stroke of a reciprocating compressor.

2. Description of the Background Art

In general, a reciprocating compressor sucks and compresses a refrigerant gas by linearly and reciprocally moving a piston in a cylinder and discharges the compressed refrigerant gas. The reciprocating compressor is classified into a recipro type compressor and a linear type compressor according to how the piston is driven.

In the recipro type compressor, a crank shaft is coupled with a rotary motor and a piston is coupled with the crank shaft, so that a rotational force of the rotary motor is changed to reciprocal movement, whereas, in the linear type compressor, a piston connected with an actuator of a linear motor is linearly moved.

Because the linear type reciprocating compressor does not have such a crank shaft which changes rotational movement to linear movement, no frictional loss possibly caused by the crank shaft occurs, and thus, its compression efficiency is high compared with a general compressor.

When the reciprocating compressor is employed in a refrigerator or in an air-conditioner, a voltage applied to a motor of the reciprocating compressor is varied to vary a compression ration of the reciprocating compressor, whereby cooling capacity of the refrigerator or the air-conditioner can be controlled.

An apparatus and method for controlling an operation of the reciprocating compressor in accordance with a conventional art will now be described with reference to FIGS. 1 to 3.

FIG. 1 is a block diagram showing the construction of an apparatus for controlling an operation of a reciprocating compressor in accordance with the conventional art.

As shown in FIG. 1, the conventional apparatus for controlling an operation of a reciprocating compressor includes: a current detecting unit 4 for detecting a current applied to a motor of the reciprocating compressor; a voltage detecting unit 3 for detecting a voltage applied to the motor; a stroke estimator 5 for calculating a stroke estimate value of the reciprocating compressor based on the detected current value, the detected voltage value and parameters (e.g., reactance of the motor, inductance or the motor, a motor constant, etc.) with respect to the motor; a comparator 1 for comparing the calculated stroke estimate value with a pre-set stroke reference value, and outputting a difference signal according to the comparison result value; a controller 2 for controlling a stroke of the reciprocating compressor by varying the voltage applied to the motor; and a power source unit 6 for applying DC power to the current detecting unit 4 and the voltage detecting unit 3.

The operation of the conventional apparatus for controlling an operation of the reciprocating compressor will now be described with reference to FIG. 2.

FIG. 2 is a flow chart of a method for controlling the operation of the reciprocating compressor in accordance with the conventional art.

As shown in FIG. 2, the conventional method for controlling the operation of the reciprocating compressor includes: detecting a voltage and a current applied to a motor of the reciprocating compressor (step S20); calculating a stroke estimate value of the reciprocating compressor based on the detected voltage value, the detected current value and parameters with respect to the motor (step S21); comparing the calculated stroke estimate value with a pre-set stroke reference value (step S22); reducing the voltage applied to the motor if the calculated stroke estimate value is larger than the pre-set stroke reference value (step S23); and increasing the voltage applied to the motor if the calculated stroke estimate value is smaller than the stroke reference value (step S24).

The method for controlling the operation of the reciprocating compressor will now be described in detail.

First, the voltage detecting unit 3 detects a voltage applied to the motor and outputs the detected voltage value to the stroke estimator 5. The current detecting unit 4 detects a current applied to the motor and outputs the detected current value to the stroke estimator 5 (step S20). Herein, in order for the voltage detecting unit 3 to detect a positive voltage and a negative voltage of the AC voltage applied to the motor, a positive DC voltage (e.g., +5V) and a negative DC voltage (e.g., −5V) are to be supplied from the power source unit 6 to a positive voltage supply terminal (+V) and a negative voltage supply terminal (−V) of an OP amplifier of the voltage detecting unit 3. Also, in order for the current detecting unit 4 to detect a positive current and a negative current of the AC current applied to the motor, a positive DC voltage (e.g., +5V) and a negative DC voltage (e.g., −5V) are to be supplied from the power source unit 6 to a positive voltage supply terminal (+V) and a negative voltage supply terminal (−V) of an operational (OP) amplifier of the current detecting unit 4.

The stroke estimator 5 calculates the stroke estimate value by applying the detected current value, the detected voltage value and parameters of the motor to equation (1) shown below, and outputs the calculated stroke estimate value to the comparator 1 (step S21):

$$x = \frac{1}{a}\int (V_M - Ri - L\dot{i})dt \tag{1}$$

wherein 'R' is resistance of the motor, 'L' is inductance of the motor, a is a motor constant, $V_M$ is a voltage value applied to the motor of the reciprocating compressor, and 'i' is a current value applied to the motor.

Thereafter, the comparator 1 compares the calculated stroke estimate value with the pre-set stroke reference value, generates a difference signal according to the comparison result value, and outputs the generated difference signal to the controller 2 (step S22).

The controller controls the stroke of the reciprocating compressor by varying the voltage applied to the motor based on the difference signal. Namely, if the calculated stroke estimate value is larger than the pre-set stroke reference value, the controller 2 reduces the voltage applied to the motor (step S23), whereas if the calculated stroke estimate value is smaller than the pre-set stroke reference value, the controller 2 increases the voltage applied to the motor (step S24).

That is, the conventional apparatus for controlling the operation of the reciprocating compressor controls the stroke of the reciprocating compressor by detecting the voltage and current applied to the motor and calculating the stroke estimate value of the reciprocating compressor based on the detected voltage and the detected current.

The power source unit 6 applies DC power to the voltage detecting unit 3 and the current detecting unit 4 so that the voltage detecting unit 3 and the current detecting unit 4 can detect the voltage and the current, respectively. Namely, the power source unit 6 applies DC voltages (e.g., +5V and −5V) to the positive voltage supply terminal (+V) and the negative voltage supply terminal (−V) of the OP amplifiers of the voltage detecting unit 3 and the current detecting unit 4, respectively, so that the voltage detecting unit 3 can detect the positive and negative voltages applied to the motor and the current detecting unit 4 can detect the positive and negative currents passing through the motor.

FIG. 3 shows the power source unit of the apparatus for controlling the operation of the reciprocating compressor in accordance with the present invention.

As shown in FIG. 3, in order to supply DC voltages (e.g., +5V and −5V) to the voltage detecting unit 3 and the current detecting unit 4, the power source unit 6 includes a positive voltage regulator L7805 and a negative voltage regulator UA7905.

However, the conventional apparatus for controlling the operation of the reciprocating compressor is disadvantages in that since it uses the elements for detecting all the positive and negative voltages of the AC voltage applied to the motor of the reciprocating compressor and the positive and negative currents of the AC current passing through the motor, costs for implementing the reciprocating compressor and its power consumption increase.

BRIEF DESCRIPTION OF THE INVENTION

Therefore, an object of the present invention is to provide an apparatus and method for controlling an operation of a reciprocating compressor capable of reducing a cost for implementing the reciprocating compressor incurred for detecting both one positive half-wave value and one negative half-wave value of a voltage and a current and also reducing power consumption by detecting only a positive or negative half-wave value of a voltage applied to a motor of the reciprocating compressor and a current passing through the motor and estimating the other remaining positive or negative half-wave value of the voltage and the current based on the detected positive or negative half-wave value.

To achieve these and other advantages and in accordance with the purpose of the present invention, as embodied and broadly described herein, there is provided an apparatus for controlling an operation of a reciprocating compressor including: a voltage detecting unit for detecting a positive half-wave voltage of an AC voltage applied to a motor of the reciprocating compressor; a current detecting unit for detecting a positive half-wave current of the AC current passing through the motor; a voltage and current estimating unit for estimating a negative half-wave voltage of the AC voltage applied to the motor and a negative half-wave current of the AC current passing through the motor based on the detected positive half-wave voltage and the detected positive half-wave current; a stroke estimating unit for estimating a stroke of the reciprocating compressor based on the detected positive half-wave voltage and the detected positive half-wave current and the negative half-wave voltage and the negative half-wave current which have been estimated by the voltage and the current estimating unit; a stroke controller for outputting a stroke control signal of the reciprocating compressor based on a comparison value between the estimated stroke estimate value and a stroke reference value of the reciprocating compressor; and a power source unit for applying positive DC power to the voltage detecting unit and the current detecting unit.

To achieve the above objects, there is also provided a method for controlling an operation of the reciprocating compressor including: detecting a positive half-wave voltage of an AC voltage applied to a motor of the reciprocating compressor and a positive half-wave current of an AC current passing through the motor; estimating a negative half-wave voltage of the AC voltage applied to the motor and a negative half-wave current of the AC current passing through the motor based on the detected positive half-wave voltage and the detected positive half-wave current; estimating a stroke of the reciprocating compressor based on the detected positive half-wave voltage and the detected positive half-wave current and the estimated negative half-wave voltage and the negative half-wave current; comparing the estimated stroke estimate value and a stroke reference value of the reciprocating compressor; and controlling a stroke of the reciprocating compressor based on the comparison result.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Figure 1:
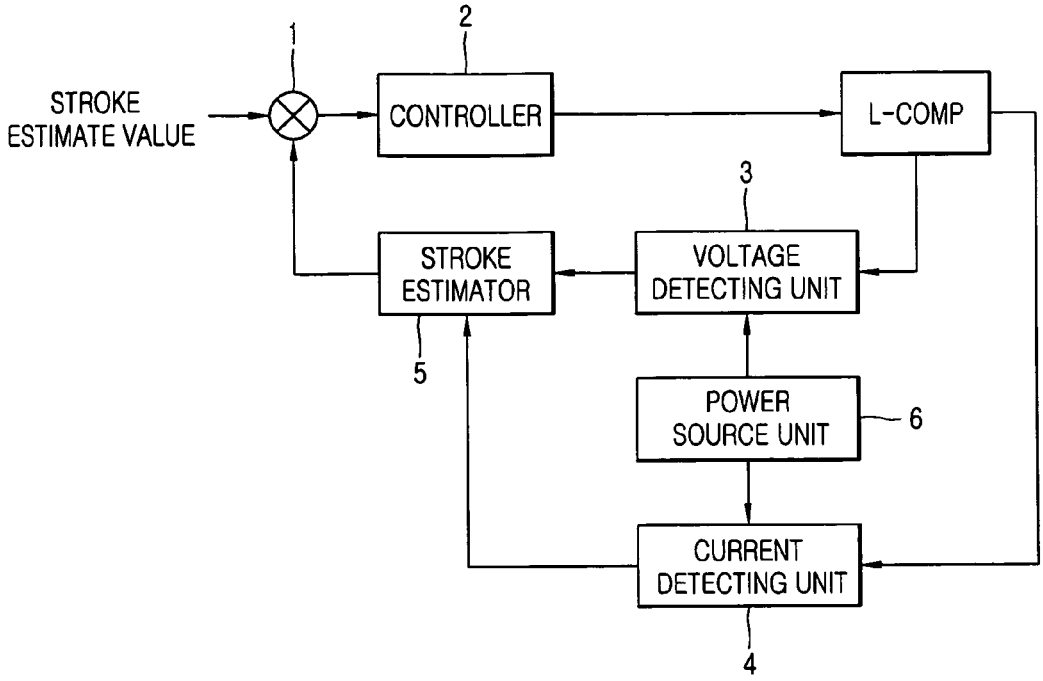
FIG. 1 BACKGROUND ART
FIG. 1 is a block diagram showing the construction of an apparatus for controlling an operation of a reciprocating compressor in accordance with a conventional art.
Figure 2:
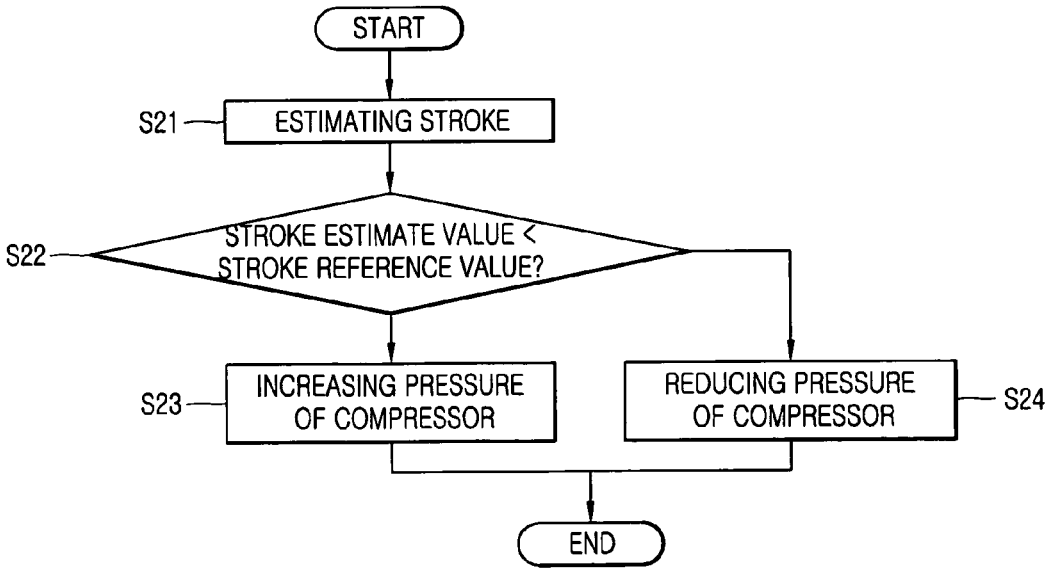
FIG. 2 BACKGROUND ART
FIG. 2 is a flow chart of a method for controlling the operation of the reciprocating compressor in accordance with the conventional art.
Figure 3:
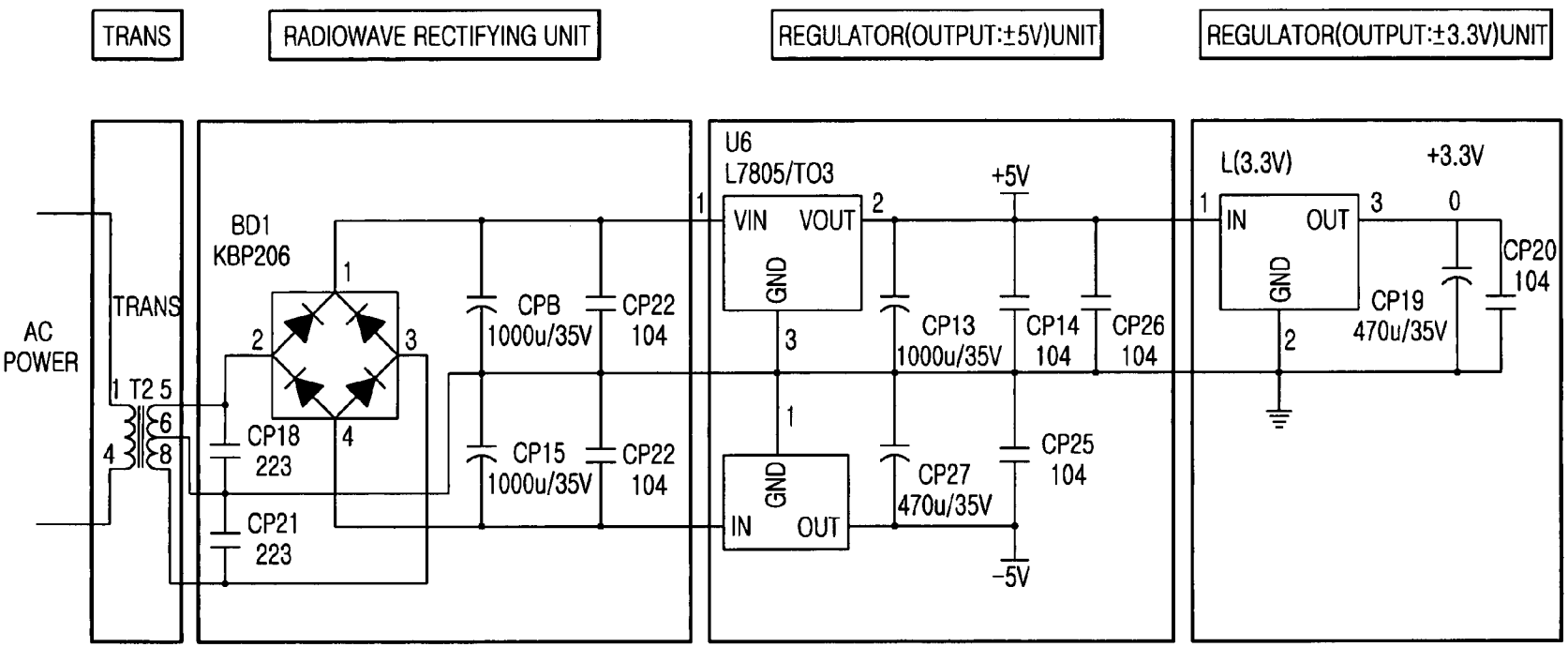
FIG. 3 BACKGROUND ART
FIG. 3 illustrates a power source unit of the apparatus for controlling the operation of the reciprocating compressor in accordance with the conventional art.
Figure 4:
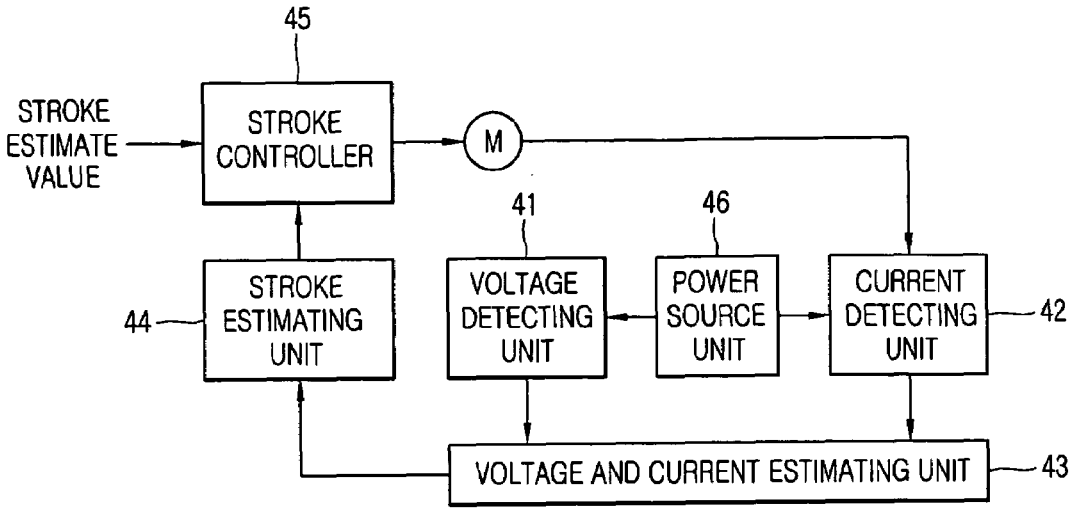
FIG. 4 is a block diagram showing the construction of an apparatus for controlling a stroke of the reciprocating compressor in accordance with the present invention.
Figure 5:
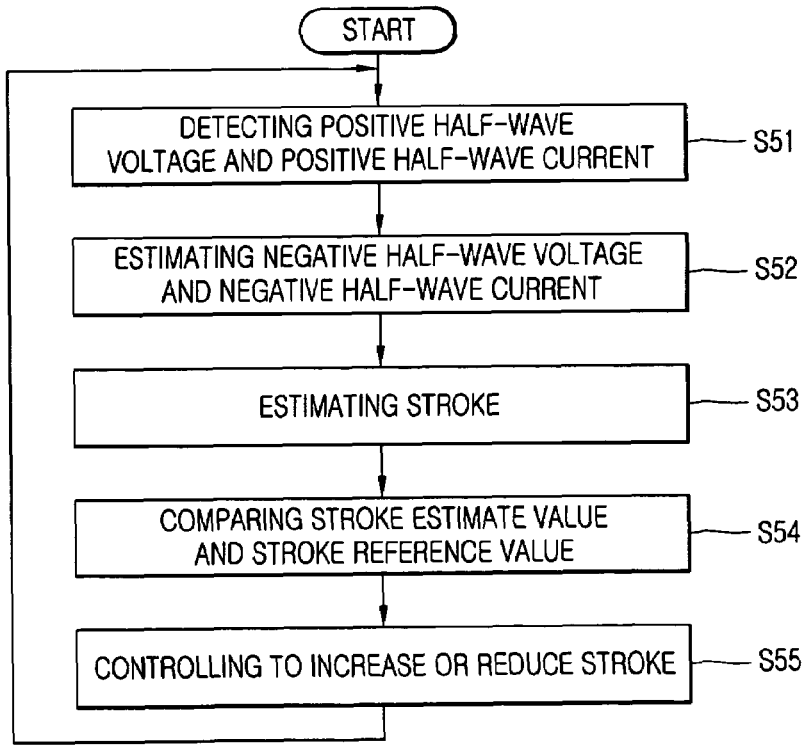
FIG. 5 is a flow chart of a method for controlling the stroke of the reciprocating compressor in accordance with the present invention.
Figure 6:
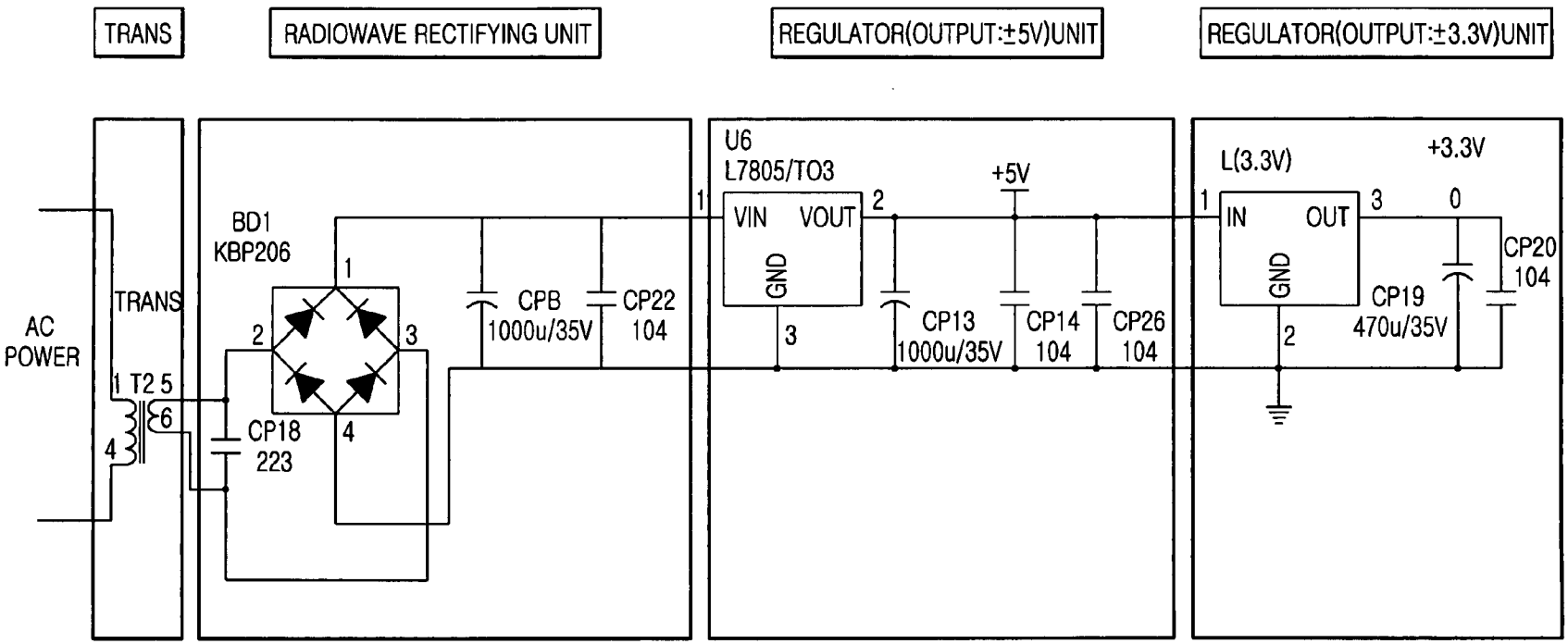
FIG. 6 shows an example of a power source unit of the apparatus for controlling the operation of the reciprocating compressor in accordance with the present invention.

An apparatus and method for controlling an operation of a reciprocating compressor capable of reducing a cost for implementing the reciprocating compressor incurred for detecting both one positive half-wave value and one negative half-wave value of a voltage and a current and also reducing power consumption by detecting only a positive or negative half-wave value of a voltage applied to a motor of the reciprocating compressor and a current passing through the motor and estimating the other remaining positive or negative half-wave value of the voltage and the current based on the detected positive or negative half-wave value, in accordance with the present invention will now be described with reference to FIGS. 4 to 6.

The reciprocating compressor in accordance with the present invention adopts a linear method.

FIG. 4 is a block diagram showing the construction of a device for controlling a stroke of the reciprocating compressor in accordance with the present invention.

As shown in FIG. 4, the apparatus for controlling a stroke of the reciprocating compressor includes a voltage detecting unit 41 for detecting a positive half-wave voltage of an AC voltage applied to a motor of the reciprocating compressor; a current detecting unit 42 for detecting a positive half-wave current of the AC current passing through the motor; a voltage and current estimating unit 43 for estimating a negative half-wave voltage of the AC voltage applied to the motor and a negative half-wave current of the AC current passing through the motor based on the detected positive half-wave voltage and the detected positive half-wave current; a stroke estimating unit 44 for estimating a stroke of the reciprocating compressor based on the detected positive half-wave voltage and the detected positive half-wave current and the negative half-wave voltage and the negative half-wave current which have been estimated by the voltage and the current estimating unit; a stroke controller 45 for outputting a stroke control signal of the reciprocating compressor based on a comparison value between the estimate stroke estimate value and a stroke reference value of the reciprocating compressor; and a power source unit 46 for applying positive DC power to the voltage detecting unit and the current detecting unit.

The operation of the apparatus for controlling the stroke of the reciprocating compressor will now be described in detail with reference to FIG. 5.

As shown in FIG. 5, the method for controlling the stroke of the reciprocating compressor includes: detecting a positive half-wave voltage of an AC voltage applied to a motor of the reciprocating compressor and a positive half-wave current of an AC current passing through the motor (step S51); estimating a negative half-wave voltage of the AC voltage applied to the motor and a negative half-wave current of the AC current passing through the motor based on the detected positive half-wave voltage and the detected positive half-wave current (step S52); estimating a stroke of the reciprocating compressor based on the detected positive half-wave voltage and the detected positive half-wave current and the estimated negative half-wave voltage and the negative half-wave current (step S53); comparing the estimated stroke estimate value and a stroke reference value of the reciprocating compressor (step S54); and controlling a stroke of the reciprocating compressor based on the comparison result (step S55).

The method for controlling the stroke of the reciprocating compressor in accordance with the present invention will be described in detail as follows.

First, the voltage detecting unit 42 detects a positive half-wave voltage of a voltage applied to the motor of the reciprocating compressor, and the current detecting unit 41 detects a positive half-wave current of a current passing through the motor (step S51). In this case, since the voltage detecting unit 41 detects only the positive half-wave voltage of the voltage, it receives only a positive DC voltage from the power source unit 46. Likewise, the current detecting unit 42 detects only the positive half-wave current of the current, it receives only a positive DC voltage from the power source unit 46.

At this time, the voltage and current estimating unit 43 estimates a negative half-wave voltage of the voltage applied to the motor of the reciprocating compressor and a negative half-wave current of the current passing through the motor of the reciprocating compressor in a symmetrical form of the positive half-wave voltage of the voltage which has been detected by the voltage detecting unit 31 and the positive half-wave current of the current which has been detected by the current detecting unit 32 (step S42).

Namely, the voltage and current estimating unit 43 measures the positive voltage of the solve applied to the motor of the reciprocating compressor and the positive current of the current passing through the compressor, and estimates the negative voltage of the voltage applied to the motor of the compressor and the negative current of the current passing through the compressor based on the measured positive voltage and the measured positive current. Since the voltage applied to the motor of the compressor and the current passing through the compressor are AC power without a DC component, the negative voltage of the voltage applied to the motor of the compressor and the negative current of the current passing through the compressor are estimated to be a symmetrical value of the positive voltage of the voltage applied to the motor of the compressor and the positive current of the current passing through the compressor. Such estimation can be implemented by software estimating the negative half-wave voltage and the negative half-wave current based on the positive half-wave voltage and the positive half-wave current without using hardware elements. For example, the negative half-wave voltage can be estimated by multiplying −1 to the measured positive half-wave voltage and shifting a phase of the multiplied positive half-wave voltage by 180°. Estimation of the negative half-wave current can be made in the same manner.

Thereafter, the stroke estimating unit 34 estimates the stroke of the reciprocating compressor based on the positive voltage of the detected voltage, the positive current of the detected current, the negative voltage of the estimated voltage and the negative current of the estimated current (step S43).

The stroke estimate value estimated by the stroke estimating unit 34 is applied to the stroke controller 35, and the stroke controller 35 compares the received stroke estimate value and a pre-set stroke reference value (step S44).

The stroke controller 35 increases or reduces the stroke of the motor of the reciprocating compressor according to the comparison result (step S45). Namely, if the estimate stroke estimate value is larger than the stroke reference value, the stroke controller 35 reduces the voltage applied to the motor of the compressor, whereas if the estimated stroke estimate value is smaller than the stroke reference value, the stroke controller 35 increases the voltage applied to the motor of the compressor.

In other words, in the present invention, in order to control the stroke of the reciprocating compressor, only the positive half-wave or negative half-wave of the voltage applied to the compressor and the current passing through the compressor is detected, the negative half-wave or positive half-wave value of the voltage and the current is estimated to have the symmetrical form of the detected positive half-wave or the detected negative half-wave, and the estimate value of the stroke of the compressor is estimated based on the detected value and the estimated value, thereby controlling the stroke of the compressor.

Since the power source unit 46 applies only the DC voltage to the voltage detecting unit 41 and the current detecting unit 42, elements of the power source unit 46 is much simpler than the power source unit of the conventional art.

FIG. 6 shows an example of a power source unit of the apparatus for controlling the operation of the reciprocating compressor in accordance with the present invention.

As shown in FIG. 6, the power source unit 46 of the present invention does not need to output a negative DC voltage (−5V), it does not have a negative voltage regulator (UA7905) nor corresponding supplementary elements.

The apparatus and method for estimating the stroke of the reciprocating compressor can be implemented such that a negative half-wave of the voltage applied to the motor of the reciprocating compressor and a negative half-wave of the current passing through the motor of the reciprocating compressor are detected and a positive half-wave of the voltage and a positive half-wave of the current are estimated to have a symmetrical form of the detected negative half-waves of the voltage and the current.

In addition, the apparatus and method for estimating the stroke of the reciprocating compressor can be implemented in the same manner by detecting a positive half-wave of the voltage applied to the motor of the reciprocating compressor and a negative half-wave of the current passing through the motor of the compressor, or by detecting a negative half-wave of the voltage applied to the motor of the compressor and a positive half-wave of the current passing through the motor of the compressor.

Accordingly, in the apparatus and method for estimating the stroke of the reciprocating compressor, only one of the positive half-wave or the negative half-wave of the voltage and the current is detected, and the other remaining half-wave is estimated based on the detected one half-wave, whereby the number of elements used for detecting the positive half-wave and the negative half-wave of the voltage applied to the compressor and the positive half-wave and the negative half-wave of the current passing through the compressor can be reduced.

As so far described, the apparatus and method for estimating the stroke of the reciprocating compressor in accordance with the present invention have the following advantages.

That is, for example, because only the positive half-wave value or the negative half-wave value of the voltage and the current applied to the motor is detected and the other remaining negative half-wave value or positive half-wave value of the voltage and the current is detected based on the detected positive half-wave value or the detected negative half-wave value, the cost for implementing the reciprocating compressor incurring for detecting both the positive half-wave value and the negative half-wave value of the voltage and the current and its power consumption can be reduced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for controlling a stroke of a reciprocating compressor comprising:

a voltage detecting unit for detecting a positive half-wave voltage of an AC voltage applied to a motor of the reciprocating compressor;

a current detecting unit for detecting a positive half-wave current of the AC current passing through the motor;

a voltage and current estimating unit for estimating a negative half-wave voltage of the AC voltage applied to the motor and a negative half-wave current of the AC current passing through the motor based on the detected positive half-wave voltage and the detected positive half-wave current;

a stroke estimating unit for estimating a stroke of the reciprocating compressor based on the detected positive half-wave voltage and the detected positive half-wave current and the negative half-wave voltage and the negative half-wave current which have been estimated by the voltage and the current estimating unit;

a stroke controller for outputting a stroke control signal of the reciprocating compressor based on a comparison value between the estimated stroke estimate value and a stroke reference value of the reciprocating compressor; and a power source unit for applying positive DC power to the voltage detecting unit and the current detecting unit.

2. The apparatus of claim 1, wherein the voltage and current estimating unit estimates a negative half-wave voltage of the AC voltage applied to the motor and a negative half-wave current of the AC current passing through the motor which have a symmetrical form of the detected positive half-wave voltage and the detected positive half-wave current.

3. A method for controlling a stroke of the reciprocating compressor comprising:

detecting a positive half-wave voltage of an AC voltage applied to a motor of the reciprocating compressor and a positive half-wave current of an AC current passing through the motor;

estimating a negative half-wave voltage of the AC voltage applied to the motor and a negative half-wave current of the AC current passing through the motor based on the detected positive half-wave voltage and the detected positive half-wave current;

estimating a stroke of the reciprocating compressor based on the detected positive half-wave voltage and the detected positive half-wave current and the estimated negative half-wave voltage and the negative half-wave current;

comparing the estimated stroke estimate value and a stroke reference value of the reciprocating compressor; and controlling a stroke of the reciprocating compressor based on the comparison result.

4. The method of claim 3, wherein, in the step of estimating the negative half-wave voltage and the negative half-wave current, the negative half-wave voltage of the AC voltage applied to the motor and the negative half-wave current of the AC current passing through the motor are estimated to have a symmetrical form of the detected positive half-wave voltage and the detected positive half-wave current.

5. An apparatus for controlling a stroke of a reciprocating compressor comprising:

a voltage detecting unit for detecting a negative half-wave voltage of an AC voltage applied to a motor of the reciprocating compressor;

a current detecting unit for detecting a negative half-wave current of the AC current passing through the motor;

a voltage and current estimating unit for estimating a positive half-wave voltage of the AC voltage applied to the motor and a positive half-wave current of the AC current passing through the motor-based on the detected negative half-wave voltage and the detected negative half-wave current;

a stroke estimating unit for estimating a stroke of the reciprocating compressor based on the detected negative half-wave voltage and the detected negative half-wave current and the estimated positive half-wave voltage and the positive half-wave current;

a stroke controller for outputting a stroke control signal of the reciprocating compressor based on a comparison value between the estimate stroke estimate value and a stroke reference value of the reciprocating compressor; and a power source unit for applying positive DC power to the voltage detecting unit and the current detecting unit.

6. The apparatus of claim 5, wherein the voltage and current estimating unit estimates a positive half-wave voltage of the AC voltage applied to the motor and a positive half-wave current of the AC current passing through the motor which have a symmetrical form of the detected negative half-wave voltage and the detected negative half-wave current.

7. An apparatus for controlling a stroke of a reciprocating compressor comprising:

a power source unit for supplying only a positive DC voltage to a voltage detecting unit for detecting an AC voltage applied to a motor of the reciprocating compressor and a current detecting unit for detecting an AC current passing through the motor; and a voltage and current estimating unit for estimating the other remaining half-wave voltage of the AC voltage and the other remaining half-wave current of the AC current based on a half-wave voltage of the detected AC voltage and a half-wave current of the detected AC current.

8. The apparatus of claim 7, wherein the voltage and current estimating unit multiplies −1 to the half-wave voltage of the detected AC voltage and the half-wave current of the detected AC current, and shifts a phase of the multiplied half-wave voltage and the multiplied half-wave current by 1800 to estimate the remaining half-wave voltage of the AC voltage and the remaining half-wave current of the AC current.

9. A method for controlling a stroke of the reciprocating compressor comprising:

detecting a negative half-wave voltage of an AC voltage applied to a motor of the reciprocating compressor and a negative half-wave current of an AC current passing through the motor;

estimating a positive half-wave voltage of the AC voltage applied to the motor and a positive half-wave current of the AC current passing through the motor in a symmetrical form of the detected negative half-wave voltage and the detected negative half-wave current;

estimating a stroke of the reciprocating compressor based on the detected negative half-wave voltage and the detected negative half-wave current and the estimated positive half-wave voltage and the positive half-wave current;

comparing the estimated stroke estimate value and a stroke reference value of the reciprocating compressor; and controlling a stroke of the reciprocating compressor based on the comparison result.

10. The method of claim 9, wherein, in the step of estimating the positive half-wave voltage and the positive half-wave current, the positive half-wave voltage of the AC voltage applied to the motor and the positive half-wave current of the AC current passing through the motor are estimated to have a symmetrical form of the detected negative half-wave voltage and the detected negative half-wave current.

* * * * *